US012404133B2

(12) United States Patent
Lauk

(10) Patent No.: US 12,404,133 B2
(45) Date of Patent: Sep. 2, 2025

(54) TARP ROLLING DEVICE

(71) Applicant: Vincent Lauk, Peshtigo, WI (US)

(72) Inventor: Vincent Lauk, Peshtigo, WI (US)

( * ) Notice: Subject to any disclaimer, the term of this patent is extended or adjusted under 35 U.S.C. 154(b) by 164 days.

(21) Appl. No.: 18/376,325

(22) Filed: Oct. 3, 2023

(65) Prior Publication Data

US 2025/0108990 A1 Apr. 3, 2025

(51) Int. Cl.
*B65H 75/40* (2006.01)
*B65H 18/08* (2006.01)
*B65H 75/44* (2006.01)

(52) U.S. Cl.
CPC ..... *B65H 18/08* (2013.01); *B65H 75/4431* (2013.01); *B65H 2403/941* (2013.01)

(58) Field of Classification Search
CPC ..... B65H 75/403; B65H 75/4431; B65H 75/4492; B65H 2403/70; B65H 2403/72; B65H 18/08
See application file for complete search history.

(56) References Cited

U.S. PATENT DOCUMENTS 2,773,547 A 12/1956 Voss
2,976,082 A 3/1961 Dahlman
4,056,241 A * 11/1977 Yates ..... B65H 54/585 242/407
5,174,625 A 12/1992 Gothier
5,180,203 A 1/1993 Goudy
5,211,440 A 5/1993 Cramaro
5,775,765 A 7/1998 Kintz
6,386,476 B1 * 5/2002 Adleman, Jr. ..... E04G 23/006 156/763
7,484,684 B2 * 2/2009 Saavedra ..... B62B 1/26 242/391
8,857,751 B1 * 10/2014 Armstrong ..... B65H 75/4494 242/391.1
10,611,599 B1 * 4/2020 Staley ..... B63B 34/50
D920,068 S 5/2021 Zhang
2013/0036580 A1 2/2013 Huang
2018/0251334 A1 * 9/2018 Behrendt ..... B65H 75/2254

FOREIGN PATENT DOCUMENTS

WO WO2014167057 10/2014

* cited by examiner

*Primary Examiner* — Sang K Kim

(57) ABSTRACT

A tarp rolling device includes a handle bracket which includes a first section slidably engaging a second section such that the handle bracket has an adjustable width. A pair of ratcheting spools is removably mountable to the handle bracket and each of the ratcheting spools includes a plurality of rods which extend across a tarp to facilitate the tarp to be rolled into a roll when the pair of ratcheting spools are rotated. The handle bracket is urged to swing downwardly thereby facilitating the handle bracket to be rotated on each of the ratcheting spools. Continuing, the handle bracket is urged to swing upwardly subsequent to being urged downwardly thereby rotating each of the ratcheting spools to wrap the tarp around the plurality of rods.

11 Claims, 6 Drawing Sheets

TARP ROLLING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rolling devices and more particularly pertains to a new rolling device for rolling a trap into a roll for storage. The device includes a pair of ratcheting spools and a handle bracket that is attachable to the ratcheting spools. Each of the ratcheting spools includes a plurality of rods that extend partially across a tarp. The handle bracket is alternatively pivoted upwardly and downwardly to facilitate the ratcheting spools to roll the tarp around the rods.

(2) Description of Related Art Including Information Disclosed Under 37 CFR 1.97 and 1.98

The prior art relates to rolling devices including a variety of tarp rolling devices that are each attached to a cargo trailer to facilitate a tarp to be either rolled for storage or unrolled to cover the cargo trailer. In no instance does the prior art disclose a portable tarp roller that can roll a tarp which is lying on the ground into a roll for storage.

BRIEF SUMMARY OF THE INVENTION

An embodiment of the disclosure meets the needs presented above by generally comprising a handle bracket which includes a first section slidably engaging a second section such that the handle bracket has an adjustable width. A pair of ratcheting spools is removably mountable to the handle bracket and each of the ratcheting spools includes a plurality of rods which extend across a tarp to facilitate the tarp to be rolled into a roll when the pair of ratcheting spools are rotated. The handle bracket is urged to swing downwardly thereby facilitating the handle bracket to be rotated on each of the ratcheting spools. Continuing, the handle bracket is urged to swing upwardly subsequent to being urged downwardly thereby rotating each of the ratcheting spools to wrap the tarp around the plurality of rods.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
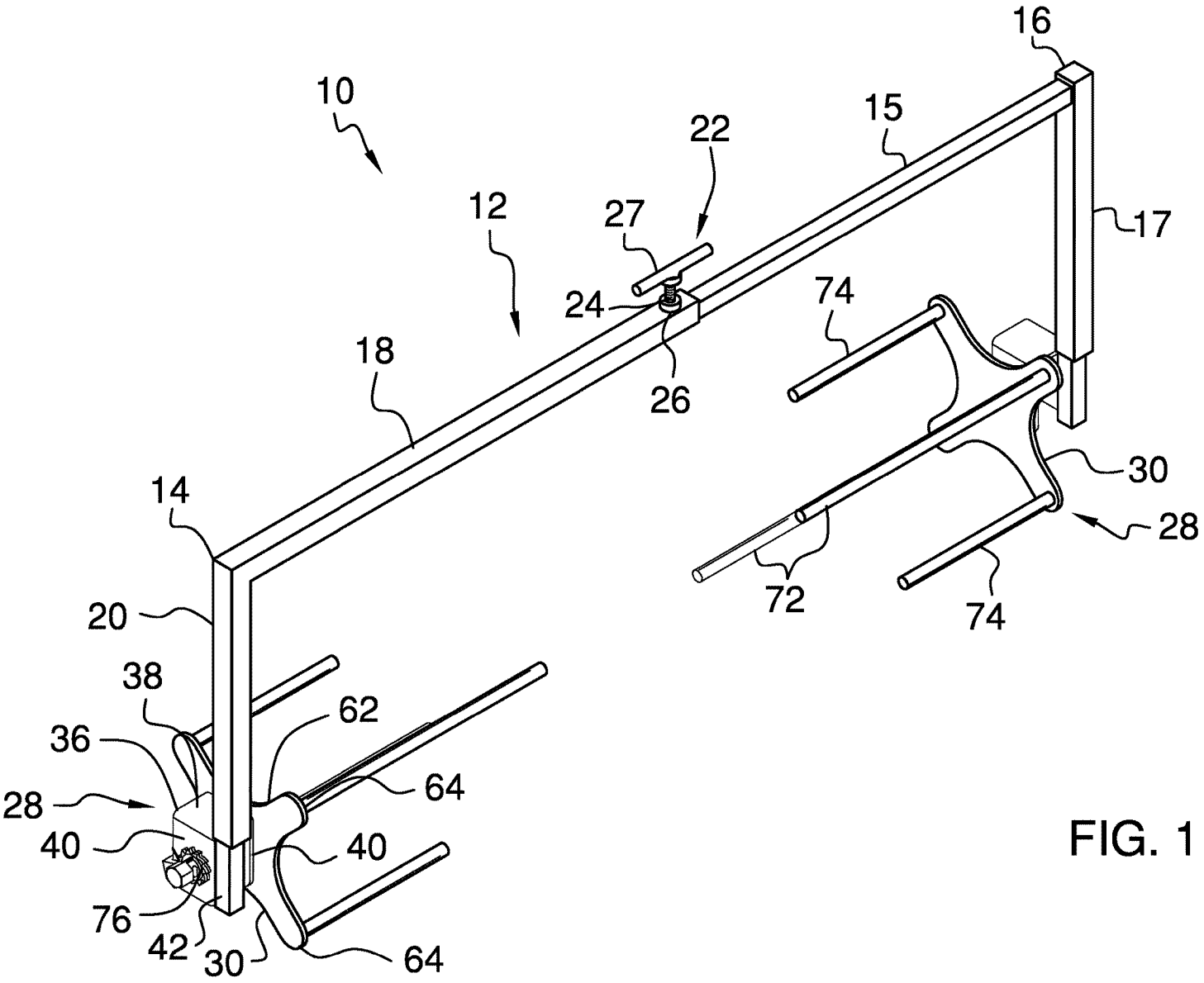
FIG. 1 is a top perspective view of a tarp rolling device according to an embodiment of the disclosure.
Figure 2:
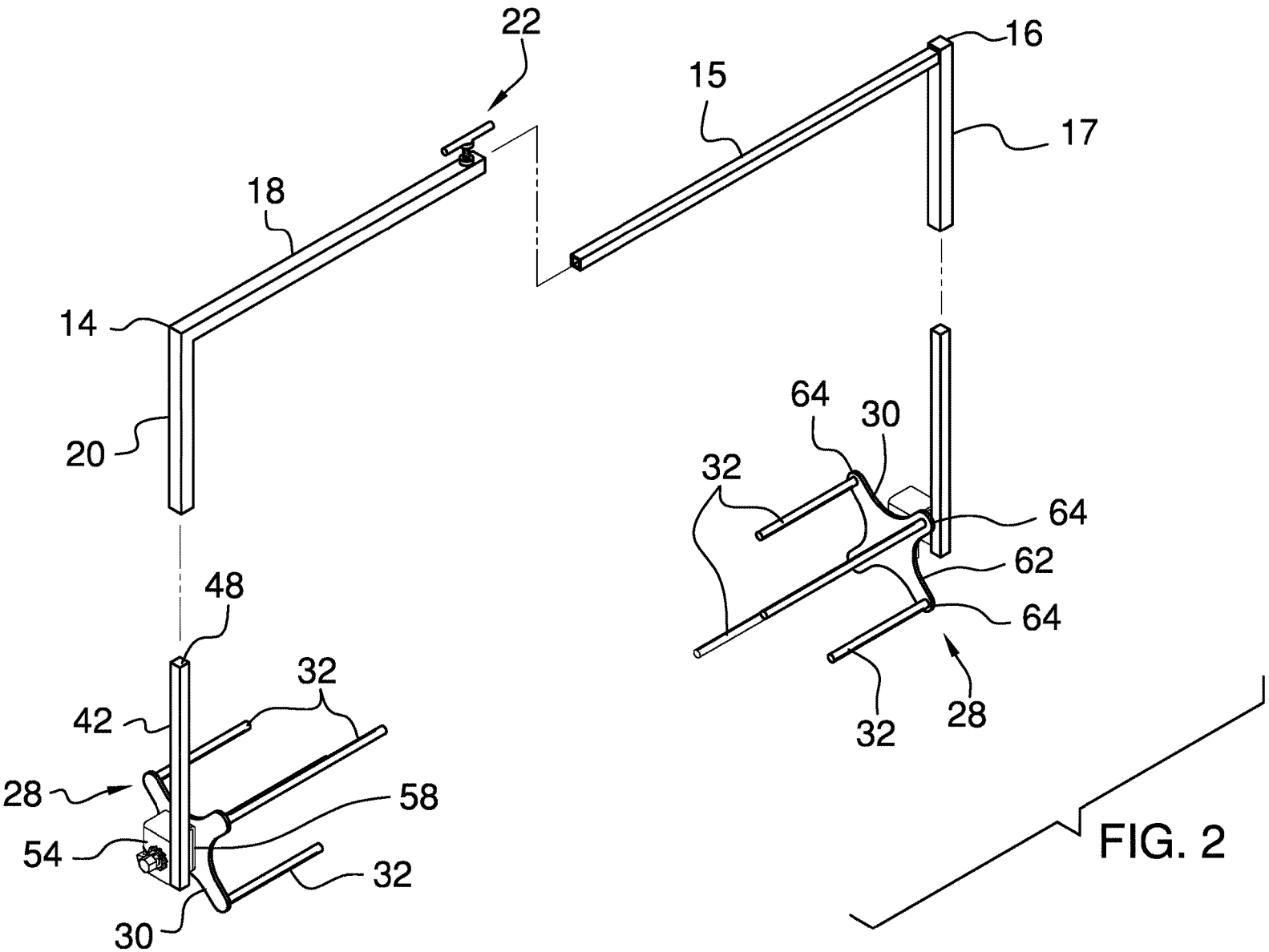
FIG. 2 is an exploded perspective view of an embodiment of the disclosure.
Figure 3:
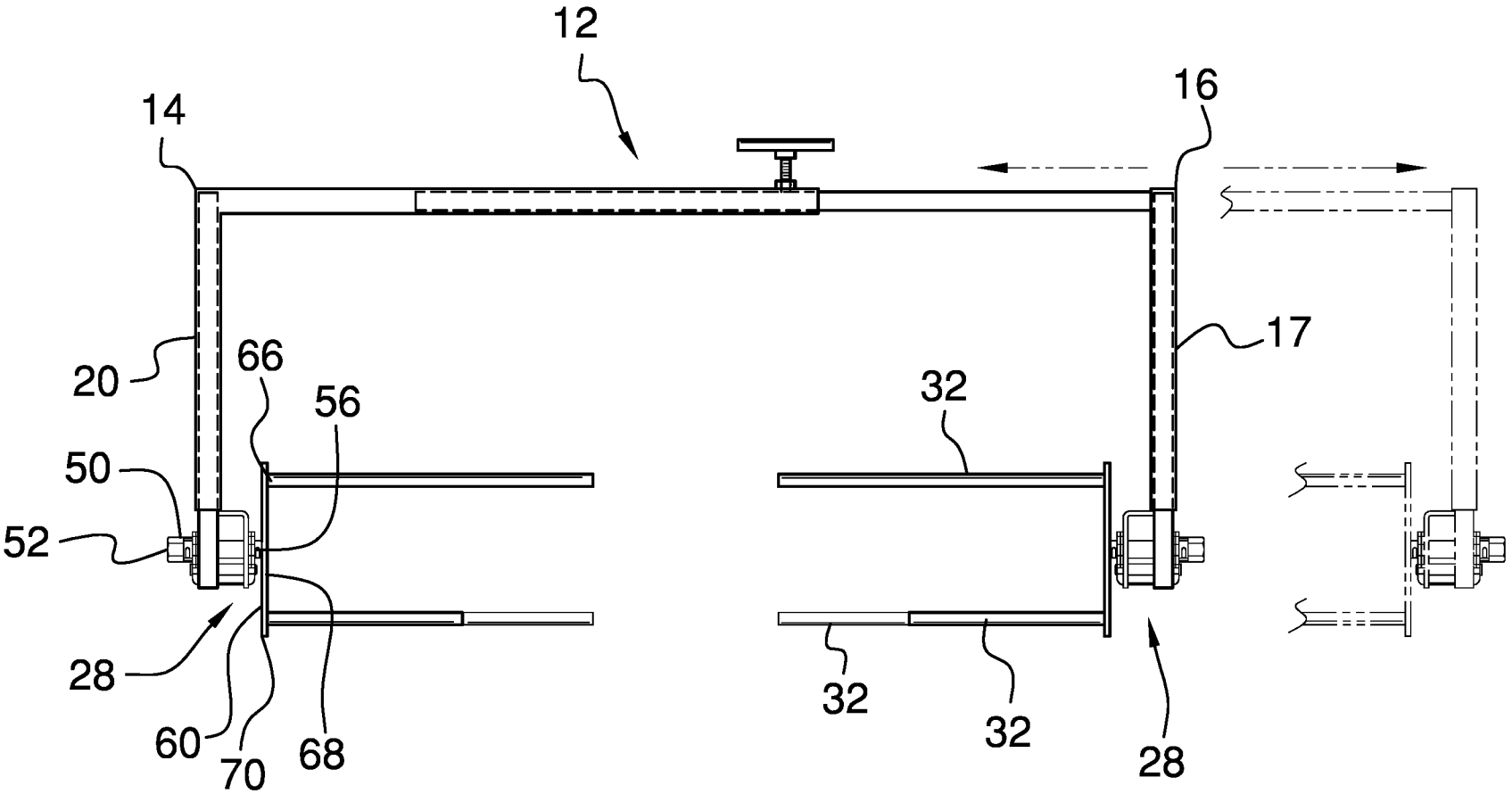
FIG. 3 is a front view of an embodiment of the disclosure.
Figure 4:
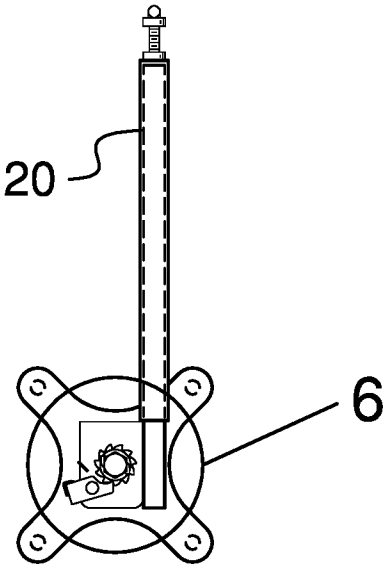
FIG. 4 is a right side phantom view of an embodiment of the disclosure.
Figure 5:
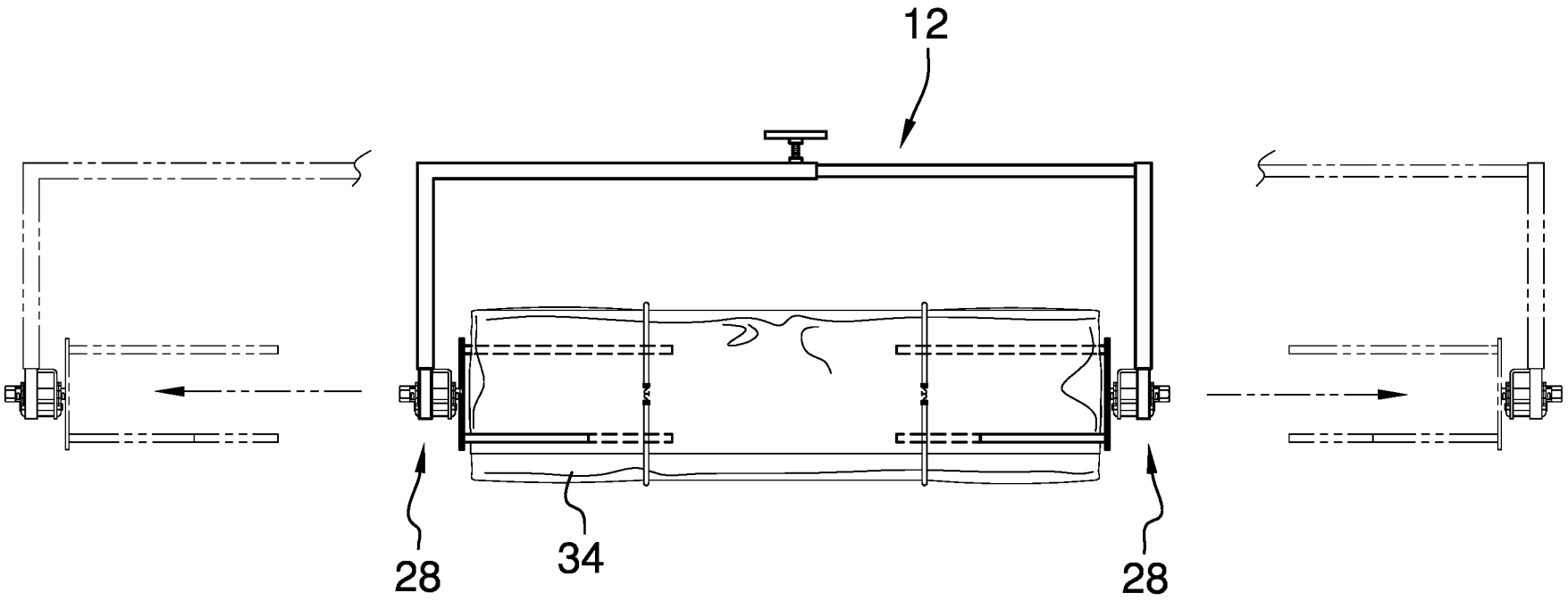
FIG. 5 is a perspective in-use view of an embodiment of the disclosure.
Figure 6:
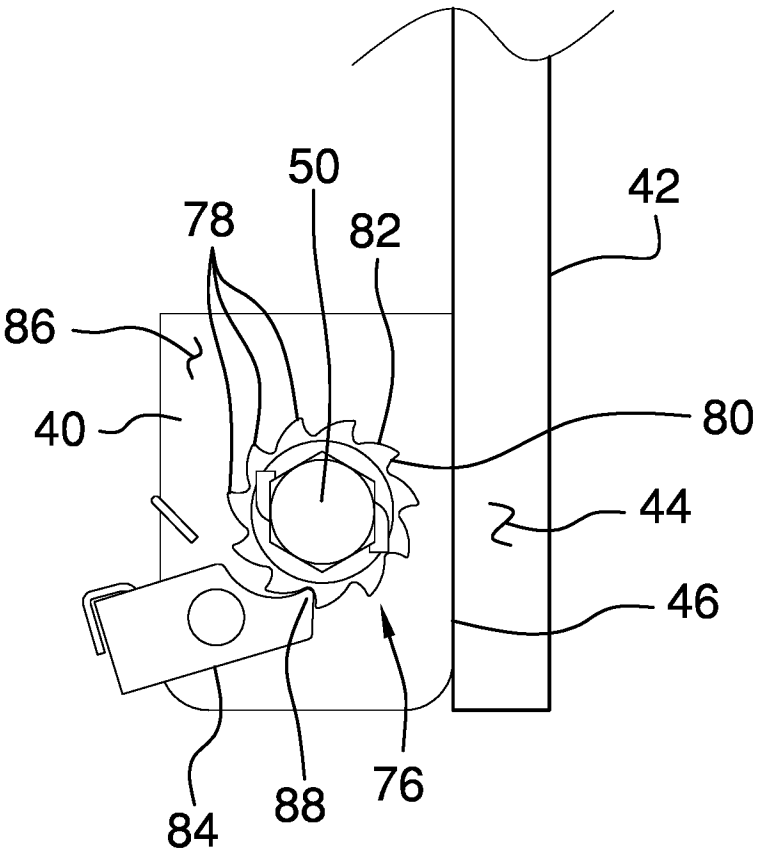
FIG. 6 is a magnified detail view taken from circle 6 of FIG. 4 of an embodiment of the disclosure.

With reference now to the drawings, and in particular to FIGS. 1 through 6 thereof, a new rolling device embodying the principles and concepts of an embodiment of the disclosure and generally designated by the reference numeral 10 will be described.

As best illustrated in FIGS. 1 through 6, the tarp rolling device 10 generally comprises a handle bracket 12 which includes a first section 14 which slidably engages a second section 16 such that the handle bracket 12 has an adjustable width. The first section 14 comprises a first tube 18 that is perpendicularly oriented with a second tube 20 and the second section 16 comprises a primary tube 15 that is perpendicularly oriented with a secondary tube 17. The first tube 18 has dimensions that are greater than dimensions of the primary tube 15. In this way the first tube 18 can insertably receive the primary tube 15 having the second tube 20 being spaced from and being oriented parallel to the secondary tube 17 such that the handle bracket 12 defines a U-shape.

A screw 22 is provided which has a shank 24 that is threadable through a nut 26 which is mounted to the first tube 18 of the first section 14. The shank 24 compresses against the first tube 18 of the second section 16 when the screw 22 is tightened for retaining the second section 16 at a desired position with respect to the first section 14. Conversely, the shank 24 is displaced from the first tube 18 of the second section 16 when the screw 22 is loosened to facilitate the second section 16 to be adjusted in the first section 14. The screw 22 may include a handle 27 that is perpendicularly oriented with the shank 24 for gripping and rotating the screw 22.

A pair of ratcheting spools 28 is provided and each of the pair of ratcheting spools 28 is removably mountable to the handle bracket 12 such that the pair of ratcheting spools 28 are oriented to face each other. Each of the pair of ratcheting spools 28 includes a wheel 30 which is rotated when the ratcheting spool 28 to which the wheel 30 is attached is rotated. Additionally, each of the ratcheting spools 28 includes a plurality of rods 32 each disposed on the wheel 30 of a respective ratcheting spool 28. The plurality of rods 32 of each of the ratcheting spools 28 extends partially across a tarp 34 to facilitate the tarp 34 to be rolled into a roll when the pair of ratcheting spools 28 are rotated. The tarp 34 may be a tarp of any conventional size or design that is commonly employed in the trucking industry for covering or securing a load.

Each of the ratcheting spools 28 comprises a spool bracket 36 that has a central panel 38 extending between a pair of outward panels 40 having the pair of outward panels 40 being spaced apart from each other and being oriented parallel to each other. Each of the ratcheting spools 28 includes a member 42 that has an outer surface 44 which is attached to a leading edge 46 of a respective one of the pair of outward panels 40 of the spool bracket 36. The member 42 extends upwardly beyond the central panel 38 such that an upper end 48 of the member 42 is spaced from the central panel 38. The second tube 20 the first section 14 and the secondary tube 17 of the second section 16 of the handle bracket 12 insertably receives the member 42 of a respective one of the ratcheting spools 28.

Each of the ratcheting spools 28 includes a shaft 50 that extends through each of the outward panels 40 such that the shaft 50 is freely rotatable in the spool bracket 36. The shaft 50 has a first end 52 that is spaced from a first one of the outward panels 54 and the shaft 50 has a second end 56 is spaced from a second one of the outward panels 58. The wheel 30 has a rear surface 60 that is attached to the second end 56 of the shaft 50 and the wheel 30 has a perimeter edge 62 which alternatively curves toward and away from a center of the wheel 30 to define a plurality of lobes 64 which are evenly spaced apart from each other and distributed around the wheel 30.

Each of the plurality of rods 32 has a coupled end 66 that is coupled to a front surface 68 of the wheel 30 and each of the rods 32 is located proximate a distal end 70 of a respective one of the lobes 64 defined on the wheel 30. Each of the rods 32 on the wheel 30 of each of the pair of ratcheting spools 28 is directed toward each other when the pair of ratcheting spools 28 is mounted to the handle bracket 12. Additionally, the plurality of rods 32 includes a set of first rods 72 and a set of second rods 74 and each of the first rods 72 has a length that is greater than a length of the second rods 74.

Each of the ratcheting spools 28 includes a gear 76 that is positioned around the shaft 50. The gear 76 is positioned between the first outward panel 54 and the first end 52 of the shaft 50 and the gear 76 has a plurality of teeth 78 distributed around the gear 76. Each of the plurality of teeth 78 has a first edge 80 that is perpendicularly oriented with respect to an outer surface 81 of the shaft 50. Additionally, each of the plurality of teeth 78 has a second edge 82 that is sloped with respect to the first edge 80.

Each of the ratcheting spools 28 includes a ratchet 84 that is pivotally coupled to an outwardly facing surface 86 of the first outward panel 54. The ratchet 84 is biased into a locking position having a finger 88 of the ratchet 84 engaging the gear 76. The finger 88 slides over the second edge 82 of each of the teeth 78 when the spool bracket 36 is rotated about the shaft 50 in a first direction. The finger 88 abuts the first edge 80 of a respective one of the teeth 78 when the finger 88 is in the locked position and the spool bracket 36 is urged to rotate about the shaft 50 in a second direction. In this way the spool bracket 36 is inhibited from rotating about the shaft 50 in the second direction such that the shaft 50 rotates with the spool bracket 36. The ratchet 84 is urgeable into an unlocked position having the finger 88 being displaced from the gear 76 thereby facilitating the spool bracket 36 to be rotated about the shaft 50 in either the first direction or the second direction.

The first tube 18 of the first section 14 and the first tube 18 of the second section 16 of the handle bracket 12 is urged to swing downwardly thereby rotating the spool bracket 36 of each of the ratcheting spools 28 to rotated about the shaft 50 in the first direction. The finger 88 of the ratchet 84 slides over the second edge 82 of each of the plurality of teeth 78 on the gear 76 thereby inhibiting the shaft 50 from being rotated with the spool bracket 36. The first tube 18 of the first section 14 and the first tube 18 of the second section 16 is urged to swing upwardly subsequent to being urged downwardly thereby rotating the spool bracket 36 of each of the ratcheting spools 28 to be rotated in the second direction about the shaft 50. Furthermore, the finger 88 of the ratchet 84 engages the first edge 80 of a respective tooth 78 on the gear 76 thereby facilitating the shaft 50 to be rotated with the spool bracket 36. In this way each of the ratcheting spools 28 can wrap the tarp 34 around the plurality of rods 32 each time the spool bracket 36 of each of the ratcheting spools 28 is urged to rotate in the second direction.

In use, the first tube 18 of the second section 16 of the handle bracket 12 is inserted into the first tube 18 of the first section 14 of and the member 42 of each of the ratcheting spools 28 is inserted into the second tube 20 of a respective first section 14 and second section 16. The tarp 34 is stretched out onto the ground, the tarp 34 is folded if necessary and the tarp 34 is positioned to facilitate the rods 32 on each of the ratcheting spools 28 to extend partially across the tarp 34. The first tube 18 of the first second and the first tube 18 of the second section 16 are repeatedly urged toward the ground and subsequently back up again in order to rotate the wheel 30 on each of the ratcheting spools 28 to roll the tarp 34 around the rods 32 until the tarp 34 is fully rolled up around the rods 32. In this way a tarp 34 of any size can be easily rolled up by a single individual while the tarp 34 is laying on the ground. The second tube 20 of the first section 14 and the secondary tube 17 of the second section 16 are each lifted from the member 42 on the respective ratcheting spool 28 and each of the ratcheting spools 28 are pulled away from the tarp 34 to pull the rods 32 out from the rolled up tarp 34. Finally, bungee cords or the like are wrapped around the rolled up tarp 34 to facilitate the tarp 34 to be stored and the pair of ratcheting spools 28 and each of the first section 14 and second section 16 are stored.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tarp rolling device for rolling a tarp into a roll for storage, said device comprising:

a handle bracket comprising a first section slidably engaging a second section such that said handle bracket has an adjustable width;

a pair of ratcheting spools, each of said pair of ratcheting spools being removably mountable to said handle bracket such that said pair of ratcheting spools are oriented to face each other, each of said pair of ratcheting spools including a wheel which is rotated when ratcheting spool to which said wheel is attached is rotated, each of said ratcheting spools including a plurality of rods each being disposed on said wheel of a respective ratcheting spool wherein said plurality of rods of each of said ratcheting spools is configured to extend partially across a tarp to facilitate the tarp to be rolled into a roll when said pair of ratcheting spools are rotated;

wherein said handle bracket is urged to swing downwardly thereby facilitating said handle bracket to be rotated on each of said ratcheting spools; and wherein said handle bracket is urged to swing upwardly subsequent to being urged downwardly thereby rotating wherein each of said ratcheting spools is configured to wrap the tarp around said plurality of rods each time said ratcheting spools is urged to rotate.

2. The device according to claim 1, wherein said first section comprises a first tube being perpendicularly oriented with a second tube, said second section comprises a primary tube being perpendicularly oriented with a secondary tube, said first tube having dimensions being greater than dimensions of said primary tube thereby facilitating said first tube to insertably receive said primary tube said second tube being spaced from and being oriented parallel to said secondary tube such that said handle bracket defines a U-shape.

3. The device according to claim 2, further comprising a screw having a shank being threadable through a nut being mounted to said first tube of said first section, said shank compressing against said first tube of said second section when said screw is tightened for retaining said second section at a desired position with respect to said first section, said shank being displaced from said first tube of said second section when said screw is loosened to facilitate said second section to be adjusted in said first section.

4. The device according to claim 2, wherein each of said ratcheting spools comprises:

a spool bracket having a central panel extending between a pair of outward panels having said pair of outward panels being spaced apart from each other and being oriented parallel to each other; and a member having an outer surface being attached to a leading edge of a respective one of said pair of outward panels of said spool bracket, said member extending upwardly beyond said central panel such that an upper end of said member is spaced from said central panel, said second tube of said first section and said secondary tube of said second section of said handle bracket insertably receiving said member of a respective one of said ratcheting spools.

5. The device according to claim 4, wherein:

each of said ratcheting spools includes a shaft extending through each of said outward panels such that said shaft is freely rotatable in said spool bracket;

said shaft has a first end being spaced from a first one of said outward panels;

said shaft has a second end being spaced from a second one of said outward panels;

said wheel has a rear surface being attached to said second end of said shaft; and said wheel has a perimeter edge which alternatively curves toward and away from a center of said wheel to define a plurality of lobes being evenly spaced apart from each other and being distributed around said wheel.

6. The device according to claim 5, wherein:

each of said plurality of rods has a coupled end being coupled to a front surface of said wheel;

each of said rods is located proximate a distal end of a respective one of said lobes defined on said wheel;

each of said rods on said wheel of each of said pair of ratcheting spools is directed toward each other when said pair of ratcheting spools is mounted to said handle bracket;

said plurality of rods includes a set of first rods and a set of second rods; and each of said first rods has a length being greater than a length of said second rods.

7. The device according to claim 5, wherein:

each of said ratcheting spools includes a gear being positioned around said shaft;

said gear is positioned between said first outward panel and said first end of said shaft;

said gear has a plurality of teeth being distributed around said gear;

each of said plurality of teeth has a first edge being perpendicularly oriented with respect to an outer surface of said shaft; and each of said plurality of teeth has a second edge being sloped with respect to said first edge.

8. The device according to claim 7, wherein:

each of said ratcheting spools includes a ratchet being pivotally coupled to an outwardly facing surface of said first outward panel;

said ratchet being biased into a locking position having a finger of said ratchet engaging said gear;

said finger sliding over said second edge of each of said teeth when said spool bracket is rotated about said shaft in a first direction;

said finger abuts said first edge of a respective one of said teeth when said finger is in said locked position and said spool bracket is urged to rotate about said shaft in a second direction thereby inhibiting said spool bracket from rotating in about said shaft in said second direction such that said shaft rotates with said spool bracket; and said ratchet is urgeable into an unlocked position having said finger being displaced from said gear thereby facilitating said spool bracket to be rotated about said shaft in either said first direction or said second direction.

9. The device according to claim 8, wherein said first tube of said first section and said primary tube of said second section of said handle bracket is urged to swing downwardly thereby rotating said spool bracket of each of said ratcheting spools to rotated about said shaft in said first direction having said finger of said ratchet sliding over said second edge of each of said plurality of teeth on said gear thereby inhibiting said shaft from being rotated with said spool bracket.

10. The device according to claim 9, wherein said first tube of said first section and said primary tube of said second section is urged to swing upwardly subsequent to being urged downwardly thereby rotating said spool bracket of each of said ratcheting spools to be rotated in said second direction about said shaft having said finger of said ratchet engaging said first edge of a respective tooth on said gear thereby facilitating said shaft to be rotated with said spool bracket wherein each of said ratcheting spools is configured to wrap the tarp around said plurality of rods each time said spool brackets of each of said ratcheting spools is urged to rotate in said second direction.

11. A tarp rolling device for rolling a tarp into a roll for storage, said device comprising:

a handle bracket comprising a first section slidably engaging a second section such that said handle bracket has an adjustable width said first section comprises a first tube being perpendicularly oriented with a second tube, said second section comprises a primary tube being perpendicularly oriented with a secondary tube, said first tube having dimensions being greater than dimensions of said primary tube thereby facilitating said first tube to insertably receive said primary tube said second tube being spaced from and being oriented parallel to said secondary tube such that said handle bracket defines a U-shape;

a screw having a shank being threadable through a nut being mounted to said first tube of said first section, said shank compressing against said first tube of said second section when said screw is tightened for retaining said second section at a desired position with respect to said first section, said shank being displaced from said first tube of said second section when said screw is loosened to facilitate said second section to be adjusted in said first section;

a pair of ratcheting spools, each of said pair of ratcheting spools being removably mountable to said handle bracket such that said pair of ratcheting spools are oriented to face each other, each of said pair of ratcheting spools including a wheel which is rotated when ratcheting spool to which said wheel is attached is rotated, each of said ratcheting spools including a plurality of rods each being disposed on said wheel of a respective ratcheting spool wherein said plurality of rods of each of said ratcheting spools is configured to extend partially across a tarp to facilitate the tarp to be rolled into a roll when said pair of ratcheting spools are rotated, each of said ratcheting spools comprising:

a spool bracket having a central panel extending between a pair of outward panels having said pair of outward panels being spaced apart from each other and being oriented parallel to each other;

a member having an outer surface being attached to a leading edge of a respective one of said pair of outward panels of said spool bracket, said member extending upwardly beyond said central panel such that an upper end of said member is spaced from said central panel, said second tube of said first section and said secondary tube of said second section of said handle bracket insertably receiving said member of a respective one of said ratcheting spools;

a shaft extending through each of said outward panels such that said shaft is freely rotatable in said spool bracket, said shaft having a first end being spaced from a first one of said outward panels, said shaft having a second end being spaced from a second one of said outward panels, said wheel having a rear surface being attached to said second end of said shaft, said wheel having a perimeter edge which alternatively curves toward and away from a center of said wheel to define a plurality of lobes being evenly spaced apart from each other and being distributed around said wheel, each of said plurality of rods has a coupled end being coupled to a front surface of said wheel, each of said rods being located proximate a distal end of a respective one of said lobes defined on said wheel, each of said rods on said wheel of each of said pair of ratcheting spools being directed toward each other when said pair of ratcheting spools is mounted to said handle bracket, said plurality of rods including a set of first rods and a set of second rods, each of said first rods has a length being greater than a length of said second rods;

a gear being positioned around said shaft, said gear being positioned between said first outward panel and said first end of said shaft, said gear having a plurality of teeth being distributed around said gear, each of said plurality of teeth having a first edge being perpendicularly oriented with respect to an outer surface of said shaft, each of said plurality of teeth having a second edge being sloped with respect to said first edge; and a ratchet being pivotally coupled to an outwardly facing surface of said first outward panel, said ratchet being biased into a locking position having a finger of said ratchet engaging said gear, said finger sliding over said second edge of each of said teeth when said spool bracket is rotated about said shaft in a first direction, said finger abutting said first edge of a respective one of said teeth when said finger is in said locked position and said spool bracket is urged to rotate about said shaft in a second direction thereby inhibiting said spool bracket from rotating in about said shaft in said second direction such that said shaft rotates with said spool bracket, said ratchet being urgeable into an unlocked position having said finger being displaced from said gear thereby facilitating said spool bracket to be rotated about said shaft in either said first direction or said second direction;

wherein said first tube of said first section and said primary tube of said second section of said handle bracket is urged to swing downwardly thereby rotating said spool bracket of each of said ratcheting spools to rotated about said shaft in said first direction having said finger of said ratchet sliding over said second edge of each of said plurality of teeth on said gear thereby inhibiting said shaft from being rotated with said spool bracket; and wherein said first tube of said first section and said primary tube of said second section is urged to swing upwardly subsequent to being urged downwardly thereby rotating said spool bracket of each of said ratcheting spools to be rotated in said second direction about said shaft having said finger of said ratchet engaging said first edge of a respective tooth on said gear thereby facilitating said shaft to be rotated with said spool bracket wherein each of said ratcheting spools is configured to wrap the tarp around said plurality of rods each time said spool brackets of each of said ratcheting spools is urged to rotate in said second direction.

* * * * *